United States Patent [19]

Bartmann

[11] 4,135,674

[45] Jan. 23, 1979

[54] ROLL-CHANGING DEVICE FOR WEB WINDING APPARATUS

[75] Inventor: Bernhard Bartmann, Heidenheim, Fed. Rep. of Germany

[73] Assignee: J.M. Voith GmbH, Fed. Rep. of Germany

[21] Appl. No.: 843,574

[22] Filed: Oct. 19, 1977

[30] Foreign Application Priority Data

Oct. 29, 1976 [DE] Fed. Rep. of Germany ..... 2649289

[51] Int. Cl.[2] ..... B65H 75/34

[52] U.S. Cl. ..... 242/64; 242/56 A; 242/66

[58] Field of Search ..... 242/64, 66, 56 A, 56.2, 242/56.9, 58.2, 58.6

[56] References Cited

U.S. PATENT DOCUMENTS

| | | | |
|---|---|---|---|
| 3,529, 785 | 9/1970 | Mistele | 242/64 X |
| 3,630,462 | 12/1971 | Nordgren | 242/64 |
| 3,752,412 | 8/1973 | Byrt | 242/56 A |
| 3,799,469 | 3/1974 | Yoshizuka | 242/56 A |

*Primary Examiner*—Edward J. McCarthy
*Attorney, Agent, or Firm*—Ostrolenk, Faber, Gerb & Soffen

[57] ABSTRACT

A plurality of webs are simultaneously wound upon a plurality of tubular cores supported in a row upon a roll rod; a pair of double-armed, rotatable levers supports the roll rod at a winding station while the webs are being wound; then the lever pivots the roll rod and the wound rolls to a delivery station where the roll rod is removed from the cores and the wound rolls are then delivered; simultaneously the lever pivots another roll rod and new cores from the delivery station to the winding station.

19 Claims, 2 Drawing Figures

Fig. 1
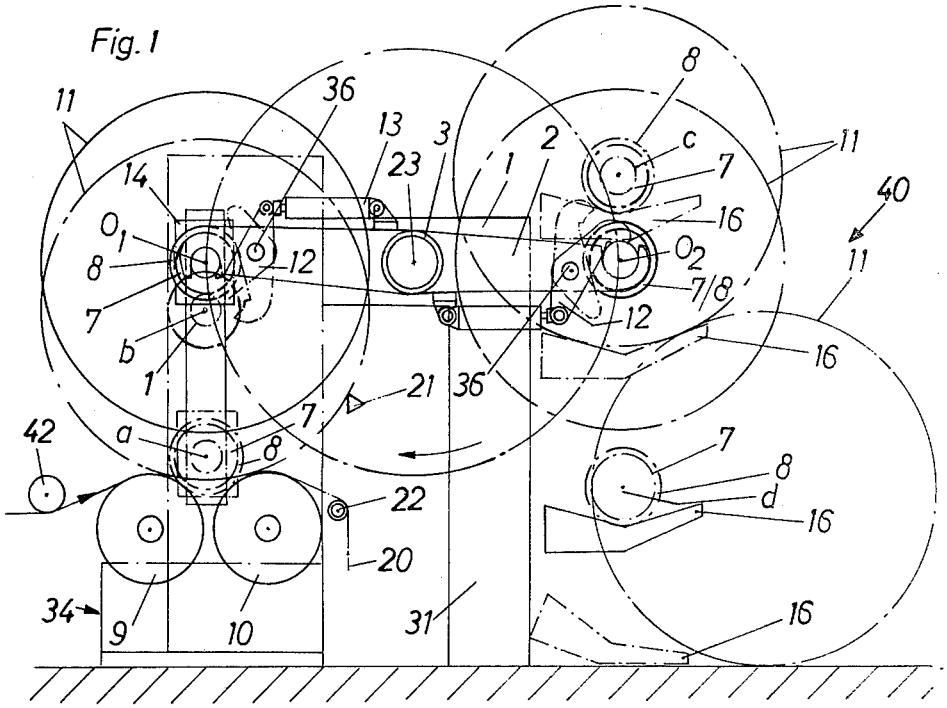
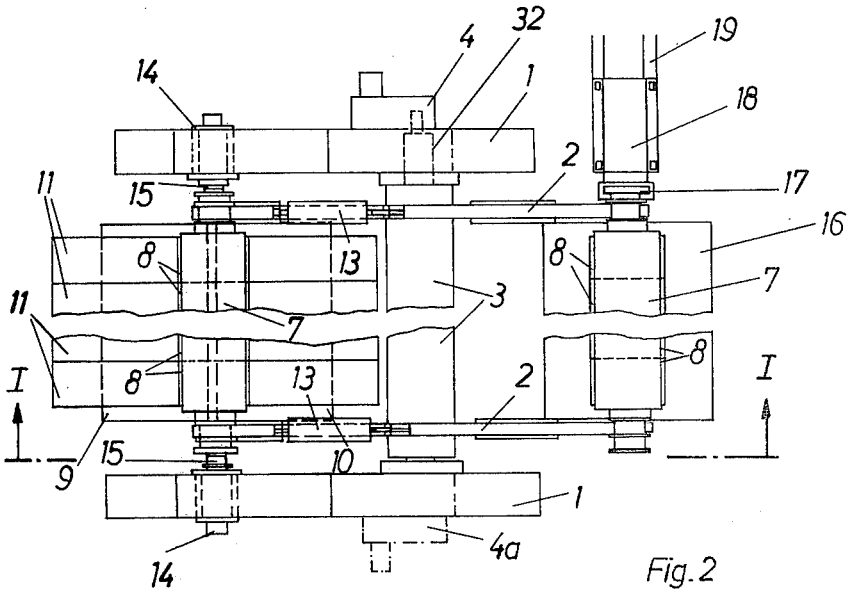
Fig. 2

ROLL-CHANGING DEVICE FOR WEB WINDING APPARATUS

The present invention relates to an apparatus for winding web material, such as paper, or the like, into rolls, and particularly relates to the roll-changing device for such an apparatus. Such apparatus moves the web cores to the winding station to enable the webs to be wound on the cores and then moves the wound rolls to a delivery station at which the wound rolls are separated from the apparatus.

BACKGROUND OF THE INVENTION

Web winding machines for creating rolls of web material include a web rolling or winding station and a delivery station to which the finished or wound rolls are delivered. At the winding station, these apparatus typically have winding or bearing rollers. The web core on which the web is to be wound is seated on the bearing rollers, the web is attached or applied to the core and the core is rotated by the bearing rollers which winds the web onto the core. In a typical arrangement, the cores for the webs comprise cardboard tubes. In some arrangements, a single quite wide web is longitudinally cut prior to its being wound on the cores, and a plurality of cores are provided corresponding in number and width to the individual webs that are being simultaneously wound. All of the cores are supported on a roll rod, which holds them in a single row. All of the cores sit upon the rotating bearing rollers.

After the single roll or the group of rolls sitting on the bearing rollers have been wound to the desired diameter, cutting means operate to transversely cut off the continuous web or webs so that the completed roll or rolls can be removed and so as to provide a starting end for each web to be wound on the next roll. Then the guiding roll rod inside all of the cores of the wound rolls is withdrawn. In the typical installation, the now finished wound rolls are rolled, more or less freely, from the rolling station to a delivery station at which they are removed from the apparatus. After this, a roll rod loaded with new web cores is emplaced on the bearing rollers and the web winding begins again.

The above described known apparatus do not precisely control the finished rolls during their trip from the rolling station to the delivery station. There is a risk of accident. There is a risk that the rolls will not be delivered in perfect alignment or in readily packageable form. In addition, the roll removal and changing stage involves a relatively long interruption of the roll-winding process, which is quite undesireable.

SUMMARY OF THE INVENTION

It is the primary object of the invention to rapidly and efficiently wind a roll or a plurality of rolls of web material.

It is another object of the invention to control the delivery of wound rolls from the rolling station to a delivery station.

It is yet another object of the invention to transfer wound rolls from the rolling station to the delivery station with minimal interruption of the winding process.

The apparatus of the invention achieves rapid exchange of a group of finished wound rolls for a new supply of cores on which web material is to be wound. Further, the invention provides more reliable transfer of the wound rolls from the winding station to the delivery station.

According to the invention, an inserted roll rod which is passed through all of the cores has sufficient bending strength for it to support a row of cores on which individual neighboring webs are wound. Typically, the individual webs have been formed by making longitudinal cuts in a wider web.

At both ends of the row of cores, there is a respective double armed lever. The center of both levers is rotatably mounted on a supporting bearing block. The center of rotation of the double armed levers is between the winding station and the delivery station such that one arm of the double armed levers pivots completed rolls from the roll winding station to the delivery station and at the same time the other arm of the levers pivots a roll rod loaded with new cores to the winding station so that web material can be wound on the cores. Because the double armed lever performs a double operation, the time required before the next set of cores is readied for web winding is greatly reduced and the danger of accidents occurring upon roll delivery is virtually non-existent.

The rigidity of the roll rod assures that the individual rolls are supported properly, even though the roll rod is actually only supported at its outer ends.

Use of a double armed lever for moving rolls during a continuous rolling process is already known in the field of paper web winding and is described in German Gebrauchsmuster No. 7 234 187. In this publication, a star-type reel unrolling appliance is described. It receives and holds rolls of paper in a paper treating machine. In this reference, a roll of paper which is held between clamping sleeves is unwound. As soon as the diameter of the roll permits it, the roll is pivoted through an arc of 180° by the double lever arm so that a new roll of paper is made available for continuous flow changeover of rolls.

The appliance described in this reference, however, only concerns the winding of ready cut paper webs with a width of between one and two meters. A plurality of adjacent cores and rolls arranged in a row cannot be handled by this appliance. The reference does not deal with an elongated core supporting roll rod, as the invention does. The operation of the invention relates to simultaneous winding and delivery of several rolls of paper. As a result, row widths of up to nine meters are possible with the invention. The rigid roll rod holds the plurality of cores and their respective rolls. Only after the rolls have been wound and delivered are they separately and individually handled.

As a further feature of the invention, at the roll winding station, there is a vertically displaceable roll rod guide, which engages and then travels vertically up from the bearing rollers with the roll rod as the cores are being wound. The ends of the arms of the double armed lever are fitted with retaining clips, and each clip engages the roll rod next to the clamped end of the roll rod guide when the roll rod has risen up to the clips due to achieving the desired winding thickness. The clips on the lever arms hold the roll rod during the roll changing process. The vertically displaceable roll rod guide permits the fully wound rolls to be lifted out of their engagement with the bearing rollers and enables the wound rolls to be swung away to the delivery station after the double armed levers engage the roll rod.

The delivery station has a lifting table for supporting the wound rolls while the roll rod is being withdrawn from the wound cores at the delivery station and then for lowering the wound rolls to a delivery surface from which they are removed. The lifting table also lifts a new set of cores to where the roll rod is inserted and delivers the roll rod to the adjacent arms of the double armed levers.

There is an insertion and withdrawal device for the roll rod at the delivery staion, which withdraws the roll rod at the delivery station to permit the wound rolls to be removed from the apparatus. The device thereafter inserts the roll rod into a new group of cores at the delivery station for the next winding procedure.

It is apparent that the apparatus according to the invention can be used with a plurality of webs arranged side or with a single web.

Other objects and features of the invention will become apparent from the following description, taken in conjunction with the accompanying drawings.

BRIEF DESCRIPTION OF THE DRAWINGS

FIG. 1 is a schematic side elevational view of the roll winding and roll changing apparatus according to the invention, with various positions of the rolls being wound and of the parts of the apparatus which operate on the rolls being wound being shown in the drawing.

FIG. 2 is a schematic plan view of the apparatus of FIG. 1.

DESCRIPTION OF A PREFERRED EMBODIMENT

An apparatus according to the inventon comprises an upstanding support 31 to which are affixed a pair of relatively widely spaced apart, stationary bearing blocks 1. A rotatable shaft 3 extends between receiving bearing openings 32 in the bearing blocks 1 whereby the shaft 3 may be rotated with respect to the block 1.

Rotary drive means 4 is connected at one end of shaft 3. A second coordinated, corresponding drive means 4a may be connected at the other end of shaft 3. When it is periodically operated, drive 4 (and/or **4*a*) rotates the shaft 3. Drives 4 and 4*a*** as appropriate may be electric, hydraulic or pneumatic and are conventional.

There are secured to shaft 3 and rotatable therewith a pair of double armed levers 2. The levers are oriented parallel to one another and they are spaced apart wider than the width of a row of cores 8 on which the webs are wound. The arms of each lever 2 extend apart in opposite directions and are 180° apart. It is the principal purpose of the shaft 3 to rotate the levers 2 in the manner described below.

Referring to the roll winding station 34, there is a common rigid roll rod 7 which is of a length to extend completely across a row of cores 8 on which webs 11 are being wound. The cores on rod 7 comprise a plurality of cardboard tubes arranged in a row on the common roll rod. When the cores are wound by the below described bearing rollers 9 and 10, the rolls 11 of web material develop around the respective cores 8.

At the roll winding station 34, a pair of driven, rotatable bearing rollers 9, 10 of the conventional variety are supported. In order to wind a roll 11, drive means (not shown) for the rollers 9, 10 rotates these rollers which, in turn, rotates the cores 8 and the webs wound thereon. The cores 8 start out sitting on the rollers and as the web is wound, the roll sits on rollers 9, 10 and is rotated thereby and wound.

At the left hand side of the support 31 and bearing blocks 1 in the drawings, there are respective roll rod guides 14 having clamping head 15 which hold the roll rods. The roll rod guides 14 and their clamping heads 15 are supported by the bearing blocks 1, but they are moveable vertically with respect to the bearing blocks 1. The roll rod guides 14 first position the roll rod 7 at the proper location between the bearing rollers 9 and 10 and also guide the vertical movement of the roll rod as the rolls 11 are being wound up to the engagement of the roll rod by the double armed levers 2 when winding is completed. Thereafter, the levers move the roll rod and the wound rolls from the winding station to the delivery station.

There are roll rod retaining clips 12 which are pivotally secured at pivots 36 at the ends of all of the arms of the double armed levers 2. A respective hydraulic device 13 for each retaining clip 12 moves the clip from its respective roll rod engaging position shown in solid lines in FIG. 1 to its roll rod releasing position shown in broken lines.

At the delivery station 40 at the right side of the drawings, there is a roll lifting table 16 on which wound rolls are delivered and also on which new cores to be wound are placed for movement into position for engagement by the double armed lever 2.

Upon delivery of the wound rolls to the delivery station, the roll rod 7 must be withdrawn from the wound cores 8 in order to enable removal of the wound rolls. Further, the roll rod must be inserted into a new supply of cores on which webs are to be wound. To this end, a roll rod insertion and withdrawal device 19 is provided. It includes a connection piece 17, which is connectable to the roll rod 7, and an axially movable carriage 18 which is movable to withdraw and insert the roll rod as required at each stage of the cycle.

Further features of the apparatus of the invention will become apparent from the following description of the operation of the apparatus.

Before web winding according to the present invention takes place, a relatively wide web of paper, or the like web material, to be wound, is cut longitudinally in a cutting device (not shown). The cut paper web moves to the apparatus from the left in FIG. 1 and moves past the idler roller 42. The adjacent webs are to be wound on respective cardboard tube cores 8, which are aligned in a row, as shown in FIG. 2. A common roll rod 7 passes through all of the tube cores 8. The roll rod 7 and their cores 8 are placed above and between the two driven bearing rollers 9 and 10. Before winding begins, the previously cut off end 20 of the web, which has been cut off by the separating or cutting device 21 prior to the previous roll changing process, is held in place away from the cores 8 by the holding and blowing device 22. Once the roll rod and cores are in place over the bearing rollers, the web end 20 is affixed to the respective cardboard tube core 8 by initiation of the blowing process, by a stapling procedure or by other affixation technique. The roll rod guides 14 are moved down along the support 31 and bearing block 1 until they clamp to the roll rod 7. The webs and the cores are now in position and condition for web winding. At the start of web winding, the roll rod 7 and cores 8 are in their dashed line position a with the cores lying on and between rollers 9, 10.

Following winding for a period of time, the group of web rolls 11 has attained the desired diameter, which is shown in dashed lines in position b, with the roll rod 7 at the position illustrated. When the rolls 11 have been completely wound and while they are in position b, the separating or cutting device 21 cuts the wound web from the incoming supply, thereby completing formation of the rolls 11.

Next, the roll rod guide 14 raises the roll rod 7 and the rolls 11 themselves by a small amount from their position b up to their position $0_1$ at which they are out of engagement with the bearing rollers 9 and 10.

With the roll rod 7 in the upraised position $0_1$, the roll rod 7 is in position for engagement by the retaining clips 12 on the adjacent arms of the levers 2. These clips are swung in from below the roll rod 7, as viewed at the left side of FIG. 1 by means of the hydraulic devices 13. By means of the clips 12, the two double armed levers 2 securely grip the roll rod 7 at both ends, between the outermost rolls 11 and the clamping head 15 of the roll rod guide 14. With the roll rod 7 now held by the clips 12, the roll rod guide 14 is unloaded and the clamping head 15 is drawn back, and the roll rod guide may then descend to its initial position above the bearing rollers 9 and 10 after receiving the next roll rod, as described below. The roll rod 7 and the wound rolls 11 are now supported only by the clips 12 and by the respective double armed levers 2.

The rolls 11 are now swung clockwise in FIG. 1 by the drive 4 rotating the shaft 3 around the center of rotation 23. The rolls 11 are moved to the delivery station 40 and are seated on the lifting table 16.

At the same time as the double armed levers 2 are delivering the wound rolls 11 to the lifting table 16, the other arms of the double armed levers are delivering a roll rod 7, loaded with new cardboard tube cores 8, to the winding station at position a.

Returning to the delivery station 40, when the wound rolls 11 are at the delivery station, the retaining clips 12 are opened by reverse movement of the respective hydraulic devices 13. The lifting table 16 next moves slightly upwardly, as shown in dashed lines, to position c and this separates the roll rod 7 from the double armed levers 2 and unloads the levers 2 and also takes the weight of supporting the wound rolls 11 off the roll rod 7.

The roll rod 7 has also been upraised to a position to be engaged by the connecting piece 17 of the insertion and withdrawal device and it is then engaged by this device. The carriage 18 of the device draws the roll rod 7 laterally out of the cores 8 of the wound rolls 11. The now freed rolls 11 are lowered to the floor by the lifting table 16. The wound rolls 11 can now be removed and transported elsewhere.

Once the rolls 11 have been removed from the lifting table 16, the lifting table returns to an intermediate position d. At this position, new cardboard tube cores 8 are loaded onto the lifting table. The table 16 and the newly loaded cores 8 sitting thereon are lifted up again to the upraised starting position c of the delivery station. At this position, the roll rod 7 is again inserted into the row of cardboard tube cores 8 from the end of the row by the carriage 18 of the withdrawal device moving the connecting piece 17 and the attached roll rod 7 into the cores 8.

Once the roll rod and cores are assembled, the roll rod with its cores is lowered by the table 16 into the starting position $0_2$ of the double armed levers 2. The retaining clips 12 are closed by the hydraulic devices 13 over the newly inserted roll rod 7. Next, the lifting table 16 is moved down to the intermediate position d out of contact with the roll rod 7 and out of the pathway of movement of the roll rod as the double armed lever 2 rotates.

The roll rod 7 with its newly supplied cores 8 are rotated by the rotation of the double armed lever 2 past the winding station location at a to the upraised winding station position $0_1$. This movement of the roll rod 7 occurs simultaneously with the swinging away of the newly wound rolls 11 from the previous winding position to the delivery station position $0_2$.

When the roll rod 7 and new cores 8 are at the position $0_1$, the roll rod guide 14 and its clamping head 15 are reattached to the roll rod 7, the retaining clips 12 holding roll rod 7 are again opened releasing the roll rod 7 and the roll rod guide with the roll rod 7 and the cardboard tubes 8 are lowered from the upward position $0_1$ by the roll rod guide 14 to the lowered position a atop the bearing rollers 9, 10.

With the new cores in position, the separated web end 20 is again attached to the new cores and winding can continue.

In a slight variation of the invention, instead of raising the finished rolls at the delivery station by means of the lifting table 16 for unloading the double armed levers 2 and releasing the weight of the wound rolls 11 from the roll rod 7 in order that it might be withdrawn, the finished rolls 11 may sit on the lifting table 16 and the double armed levers can be lowered once the retaining clips 12 have been released, by an amount sufficient to free the roll rod 7 to be drawn out sideways.

The roll changing device according to the invention can also be used in the same way in a drum mounting arrangement. For this to happen, only one more intermediate stage is required. After the retaining clips 12 have been closed to move the wound rolls 11 from the winding station to the delivery station, the drum mounting is lowered out of the way so that when the roll rod 7 with its new supply of cores is swung into place, the cores will not strike against the drum mounting from below. When the roll rod 7 and its new cores is moved upward into the winding station, then the drum mounting is lifted again from below and is connected to the roll rod 7. After this connection, the retaining clips 12 can again be opened and the roll rod 7, with its cores 8 in place, can again be lowered into the roll commencing position a.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. In a web roll winding machine, including a winding station for winding a web roll and a separate wound roll delivery station which is spaced from said winding station and to which a wound roll is to be delivered;

a roll changing apparatus, comprising:

a bearing block; a bearing block pivot mount positioned between said winding station and said delivery station;

a double arm lever having a first and a second arm, said lever being rotatively supported on said pivot mount on said bearing block for rotation of said lever;

a respective roll support rod engageable with each said arm of said lever, such that a plurality of wound rolls and of the cores on which the rolls are wound are supported on and moved by and with said roll support rod; said rod being of a length and a bending strength enough to support a plurality of cores and wound rolls in a row along said rod, said lever first arm being movable from said winding station to said delivery station for moving a wound roll from said winding station to said delivery station; said lever second arm being at the same time movable from said delivery station to said winding station for moving new cores for web winding to said winding station; drive means for periodically moving said lever as described.

2. In the web roll winding machine of claim 1, said roll changing apparatus further comprising:

two of said double arm levers being provided, and being aligned with each other and being connected for rotation together with respect to said bearing block; each said lever supporting a respective side of said roll support rod beyond the respective end of the web cores supported on said rod.

3. In a web roll winding machine, including a winding station for winding a web roll and a separate wound roll delivery station which is spaced from said winding station and to which a wound roll is to be delivered;

a roll changing apparatus, comprising:

a bearing block; a double arm lever having a first and a second arm, said lever being rotatively supported on a pivot mount on said bearing block for rotation of said lever; said bearing block pivot mount being positioned between said winding station and said delivery station;

said lever first arm being movable from said winding station to said delivery station for moving a wound roll from said winding station to said delivery station; said lever second arm being at the same time movable from said delivery station to said winding station for moving new cores for web winding to said winding station; drive means for periodically moving said lever as described;

a roll support rod of sufficient bending strength to support wound rolls and being engageable with each said arm of said lever, such that the rolls and the cores on which the rolls are wound are supported on and moved by and with said roll support rod;

roll rod engaging means on each of said first and said second lever arms and being spaced from said pivot mount for engaging and holding said rod as said lever rotates.

4. In the web roll winding machine of claim 3, said roll changing apparatus further comprising:

said rod engaging means comprising retaining clips, and means for closing and opening said clips over said rod for respectively holding said rod for movement with said lever and for releasing said rod so as not to have said rod move with said lever.

5. In a web roll winding machine, including a winding station for winding a web roll and a separate wound roll delivery station which is spaced from said winding station and to which a wound roll is to be delivered;

a roll changing apparatus, comprising:

a bearing block; a double arm lever having a first and a second arm, said lever being rotatively supported on a pivot mount on said bearing block for rotation of said lever; said bearing block pivot mount being positioned between said winding station and said delivery station;

said lever first arm being movable from said winding station to said delivery staion for moving a wound roll from said winding station to said delivery station; said lever second arm being at the same time movable from said delivery station to said winding staion for moving new cores for web winding to said winding station; drive means for periodically moving said lever as described;

a roll support rod of sufficient bending strength to support wound rolls and being engageable with each said arm of said lever, such that the rolls and the cores on which the rolls are wound are supported on and moved by and with said roll support rod;

said winding station including winding means for winding a web roll; a vertically displaceable roll rod guide which is displaceable with respect to said winding means;

a clamping head on said roll rod guide for holding said rod to move with said roll rod guide.

6. In the web roll winding machine of claim 5, said roll changing apparatus further comprising:

said winding means comprising two parallel bearing rollers that are spaced and sized such that a core on which a web is to be wound is seated on both said rollers and the core is placed between both said rollers and the roll is wound as the core and the wound roll seats on said bearing rollers.

7. In the web roll winding machine of claim 5, said roll changing apparatus further comprising:

roll rod engaging means on each said lever arm and spaced from said pivot mount for engaging and holding said rod as said lever rotates.

8. In the web roll winding machine of claim 7, said roll changing apparaatus further comprising:

two of said double arm levers being provided, and being aligned with each other and being connected for rotation together with respect to said bearing block each said lever supporting a respective side of a said roll support rod beyond the respective end of the web cores supported on said rod.

9. In a web roll winding machine, including a winding station for winding a web roll and a separate wound roll delivery station which is spaced from said winding station and to which a wound roll is to be delivered;

a roll changing apparatus, comprising:

a bearing block; a double arm lever having a first and a second arm, said lever being rotatively supported on a pivot mount on said bearing block for rotation of said lever; said bearing block pivot mount being positioned between said winding station and said delivery station;

said lever first arm being movable from said winding station to said delivery station for moving a wound roll from said winding station to said delivery station; said lever second arm being at the same time movable from said delivery station to said winding station for moving new cores for web winding to said winding station; drive means for periodically moving said lever as described;

a roll support rod of sufficient bending strength to support wound rolls and being engageable with each said arm of said lever, such that the rolls and the cores on which the rolls are wound are supported on and moved by and with said roll support rod;

at said delivery station, said roll changing apparatus comprising a lifting table which is vertically movable to various positions between a position generally at which said table engages a core and roll that is being supported by one said lever arm and moves that core and roll to a position at which said table has lowered a completed wound roll to a delivery surface.

10. In the web roll winding machine of claim 9, said roll changing apparatus further comprising:

at said delivery station, said roll changing apparatus comprising a roll rod insertion and withdrawal device for engaging a roll rod at said delivery station and for withdrawing said roll from the cores that said roll rod is supporting and for inserting a said roll rod into cores that are being supported at said delivery station;

with said roll rod in engagement with said insertion device, said lifting table being adapted to lift the wound rolls that are at said delivery station and new cores that are at said delivery station to free said roll rod for withdrawal and insertion, respectively.

11. In the web roll winding machine of claim 10, said roll changing apparatus further comprising:

said roll rod insertion and withdrawal device comprising means for engaging and selectively withdrawing and inserting a said roll rod axially of said roll rod.

12. In a web roll winding machine, including a winding station for winding a web roll and a separate wound roll delivery station which is spaced from said winding station and to which a wound roll is to be delivered;

a roll changing apparatus, comprising:

a bearing block; a double arm lever having a first and a second arm, said lever being rotatively supported on a pivot mount on said bearing block for rotation of said lever; said bearing block pivot mount being positioned between said winding station and said delivery station;

said lever first arm being movable from said winding station to said delivery station for moving a wound roll from said winding station to said delivery station; said lever second arm being at the same time moveable from said delivery station to said winding station for moving new cores for web winding to said winding station; drive means for periodically moving said lever as described;

a roll support rod of sufficient bending strength to support wound rolls and being engageable with each said arm of said lever, such that the rolls and the cores on which the rolls are wound are supported on and moved by and with said roll support rod;

at said delivery station, said roll changing apparatus comprising a roll rod insertion and withdrawal device for engaging a roll rod at said delivery station and for withdrawing said roll rod from the cores that said roll rod is supporting and for inserting a said roll rod into cores that are being supported at said delivery station.

13. In the web roll winding machine of claim 12, said roll changing apparatus further comprising:

said roll rod insertion and withdrawal device comprising means for engaging and selectively withdrawing and inserting a said roll axially of said roll rod.

14. In a web roll winding machine, including a winding station for winding a web roll and a separate wound roll delivery station which is spaced from said winding station and to which a wound roll is to be delivered;

a roll changing apparatus, comprising:

a bearing block; double arm lever means having a first and a second arm, said lever means arms being supported on a support on said bearing block for movement of said lever arms with respect thereto; said bearing block support being positioned between said winding station and said delivery station;

said lever first arm being movable from said winding station to said delivery station for moving a wound roll from said winding station to said delivery station; said lever second arm being at the same time movable from said delivery station to said winding station for moving new cores for web winding to said winding station; drive means for periodically moving said lever arms as described;

a roll support rod of sufficient length and bending strength to support a plurality of cores and wound rolls in a row along said rod and being engageable with each said arm of said lever, such that the rolls and the cores on which the rolls are wound are supported on and moved by and with said roll support rod.

15. In the web roll winding machine of claim 14, said roll changing apparatus further comprising:

said winding station including winding means for winding a web roll; a vertically displaceable roll rod guide, which is displaceable with respect to said winding means;

a clamping head on said roll rod guide for holding said rod to move with said roll rod guide.

16. In the web roll winding machine of claim 15, said roll changing apparatus further comprising:

roll rod engaging means on each said lever arm and spaced from said support for engaging and holding said rod as said lever arms move.

17. In the web roll winding machine of claim 14, said roll changing apparatus further comprising:

at said delivery station, said roll changing apparatus comprising a lifting table which is vertically movable to various positions between a position generally at which said table engages a core and roll that is being supported by one said lever arm and moves that core and roll to a position at which said table has lowered a completed wound roll to a delivery surface.

18. In the web roll winding machine of claim 14, said roll changing apparatus further comprising:

at said delivery station, said roll changing apparatus comprising a roll rod insertion and withdrawal device for engaging a roll rod at said delivery station and for withdrawing said roll rod from the cores that said roll rod is supporting and for inserting a said roll rod into cores that are being supported at said delivery station.

19. In combination, the web roll winding machine of either of claims 1 or 14, and a plurality of cores, each for receiving a respective wound web roll; said plurality of cores being arrayed in a row along said rod.

* * * * *